US010647387B2

(12) United States Patent
Dombois

(10) Patent No.: US 10,647,387 B2
(45) **Date of Patent: *May 12, 2020**

(54) SELF-PROPELLING HYDROFOIL DEVICE

(71) Applicant: Markus Dombois, Stockton, CA (US)

(72) Inventor: Markus Dombois, Stockton, CA (US)

(73) Assignee: Dombois Designs Inc., Stockton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,355

(22) Filed: Oct. 4, 2018

(65) Prior Publication Data

US 2019/0054980 A1 Feb. 21, 2019

Related U.S. Application Data

(63) Continuation of application No. 15/679,149, filed on Aug. 16, 2017, now Pat. No. 10,118,668.

(60) Provisional application No. 62/376,329, filed on Aug. 17, 2016.

(51) Int. Cl.

| | |
|---|---|
| ***B63B 1/28*** | (2006.01) |
| ***B63B 35/79*** | (2006.01) |
| ***B63B 1/24*** | (2020.01) |

(52) U.S. Cl.

CPC ..... *B63B 1/286* (2013.01); *B63B 1/242* (2013.01); *B63B 1/248* (2013.01); *B63B 35/7923* (2013.01)

(58) Field of Classification Search

CPC .. B63B 1/00; B63B 1/24; B63B 1/242; B63B 1/248; B63B 1/26; B63B 35/7923; B63B 35/7953; B63B 1/28; B63B 1/286; B63B 35/73; B63B 35/79

USPC ..... 114/39.15, 39.24, 274, 280

See application file for complete search history.

(56) References Cited

U.S. PATENT DOCUMENTS

| | | | | |
|---|---|---|---|---|
| 4,579,076 | A * | 4/1986 | Chaumette | B63B 1/28 114/275 |
| 5,249,998 | A * | 10/1993 | Woolley | B63B 1/26 114/274 |
| 6,234,856 | B1 * | 5/2001 | Woolley | B63B 1/248 114/274 |
| 8,979,604 | B1 * | 3/2015 | Woolley | B63B 1/248 114/274 |
| 9,056,654 | B1 * | 6/2015 | Fraser | B63B 1/248 |
| 9,085,343 | B2 * | 7/2015 | Modica | B63B 1/24 |
| 9,586,651 | B2 * | 3/2017 | Modica | B63B 1/24 |
| 9,789,935 | B1 | 10/2017 | Aguera | |
| 9,896,158 | B2 * | 2/2018 | Modica | B63B 1/24 |
| 10,118,668 | B2 * | 11/2018 | Dombois | B63B 1/286 |
| 2015/0225040 | A1 * | 8/2015 | Geislinger | B63B 1/242 114/274 |

* cited by examiner

*Primary Examiner* — Lars A Olson

(57) ABSTRACT

The present disclosure provides generally for a hydrofoil system that may allow a surfboard to glide above the water surface. According to the present disclosure, a rider may be able to manipulate a hydrofoil device attached to a surfboard with limited training and athletic ability. The present disclosure provides for a hydrofoil system that may allow riders to use a light leaning motion to adjust the angle of a front wing to create forward thrust to produce a flow for creating lift. In some aspects, the front wing may tilt to reduce downward drag force in a lifting phase while locking into place during a glide to provide a sustained lift of the surfboard out of the water.

20 Claims, 16 Drawing Sheets

SELF-PROPELLING HYDROFOIL DEVICE

CROSS-REFERENCE TO RELATED APPLICATIONS

This application is a continuation of, and claims the benefit of priority to U.S. Nonprovisional patent application Ser. No. 15/679,149 (filed Aug. 16, 2017, and titled "SELF-PROPELLING HYDROFOIL DEVICE"), which claims the benefit of priority to U.S. Provisional Patent Application Ser. No. 62/376,329 (filed Aug. 17, 2016, and titled "SELF-PROPELLING HYDROFOIL DEVICE"), the entire contents of which applications are incorporated herein by reference, for all purposes.

BACKGROUND OF THE DISCLOSURE

In ancient Hawaii, surfboards were originally used as a luxury and a status symbol. Nobles rode boards that could be as long as 25 feet, referred to as Alii boards, while others used 7 foot long boards, referred to as Alaia boards. These boards were usually made of wood, which made the boards incredibly heavy.

Over time, changes were made to the original surfboard to reduce its size and its weight. This lead to the creation of the hollow surfboard. One of the very first hollow surfboards was the Cigar Board, which had holes drilled into a redwood board with an additional wood encasing. The Cigar Board went on to become the first surfboard to be mass-produced. Eventually, balsa wood reduced the weight of a surfboard by a precipitous amount, which allowed for increased portability. Redwood and plywood would also be substituted when balsa wood was not otherwise available.

The next innovation in the surfboard sphere was reshaping the design to make it more hydrodynamic. Surfers began tapering the tail end of their boards to help maneuverability on the ocean surface. This increased maneuverability helped riders navigate on the curl of a wave and allowed riders to maneuver in the "pipe" of a wave, leading these boards to be referred to as "hot curl" boards. A fin redesign created the fixed-tail fin, which increased maneuverability and directional stability. This was further iterated on and lead to the creation of the double fin and the triple fin.

After World War II, fiberglass was used to create lighter boards for riding waves, as was plastics and STYROFOAM. Eventually fiberglass was layered over an expanded polystyrene core to create a board that was stronger and lighter. A shortboard was eventually created, reducing the length of a surfboard to around 6 feet, allowing surfers to more easily ride in the pocket of a wave. The shortboard further increased maneuverability, allowed for greater performance style surfing, with sharper turns and greater acceleration.

As a result, surfboards are now made of relatively light material to support an individual standing on them on an ocean surface. Additionally, the material is strong enough to withstand breaking waves. Modern surfboards are made of polyurethane or polystyrene foam covered with layers of fiberglass cloth, with a polyester or epoxy resin, though some boards are experimenting with carbon fiber and Kevlar composites. Incremental, quality of life changes to the surfing experience, like combining a suction cup with a surgical cord to create a surf leash, also helped adapt surfboards to modern needs and increase portability. Surfboards now exist for almost every type of wave and skill level.

For example, standup paddle boarding ("SUP") is an extension of prone surfing. A SUP allows boarders to stand on their boards and use a paddle to propel themselves through water. Some have combined the SUP with a hydrofoil, a lifting surface that operates in water, to create a foilboard. A foilboard is a surfboard with a hydrofoil that extends below the board into the water. This design causes the board to leave the surface of the water at variable speeds. The hydrofoil uses a stand-up design that allows a rider to glide with a moving wave.

However, a foilboard relies on harnessing swell energy to propel a rider. As speed increases, a foilboard creates lift. Instead of creating drag, speed is increased because the foilboard is lifted out of the water. If attached to a craft, such as a boat, the craft must be moving fast enough to achieve enough fluid flow speed over the hydrofoil to create lift. For an individual on a board, this requires high athletic ability to operate. Novices who have little experience on a SUP, or who otherwise have little athletic ability, may not be able to easily use a foilboard.

Athletic riders of foilboards have learned to reduce the length of the SUP to shorten the SUP to almost the size of prone surfboards, with some riders eliminating paddles. By using an energetic rocking and pumping motion, these riders are able to ride these boards through flat water between the waves once they have initiated some speed by taking off on a wave or sometimes an ocean swell. Through this vigorous rocking and pumping, these riders are able to propel the board onto the next wave and across considerable distances. Others use a boat to get pulled to start initiating some speed. Once they let go of the rope, they use the pumping and rocking motion to sustain the distance of their ride.

SUMMARY OF THE DISCLOSURE

What is needed is a hydrofoil system that can be used in relatively calm waters like a lake or serene ocean. Further what is needed is a hydrofoil system that may allow amateurs and those with little athletic capability to effectively use a hydrofoil system with limited training or use. This may require a hydrofoil system that may greatly reduce the energy needed to propel the device on flat water by adding buoyancy to the hydrofoil, increasing the lifting wing size, and adding a hinge that allows the wing to reduce downward drag force in a lifting mode. Accordingly, the present disclosure provides for a hydrofoil system that may allow riders to use a light leaning motion to adjust the angle of a front wing to create forward thrust to produce a flow for creating lift. In some aspects, the front wing may tilt to reduce downward drag force in a lifting phase while locking into place during a glide to provide a sustained lift of the paddleboard out of the water. Different materials may be used to enhance the lifting effect.

By reducing the drag force, the energy needed to propel the device forward will be greatly reduced since it reduces the friction of the foil in lifting mode. In some embodiments, this allows a large concave front foil to lock into place to facilitate forward thrust from a pumping action. In some implementations, the larger forward wing with a concave undersurface may allow for more efficient pumping of water to create a forward thrust. In some aspects, a larger wing may greatly increase the device's gliding ability.

In some embodiments, a rear wing may direct an angle of attack of the forward lifting foil while in glide or take-off mode. In some implementations, a skimming sensor may affect a change in the angle of the rear, or hinged, wing to change the angle of attack on the forward lifting foil. In some aspects, this may shift the foil from take-off mode to gliding mode. In some embodiments, a skimming sensor may reduce the angle of the rear foil to reduce the overall friction by putting the fuselage of the hydrofoil in a horizontal mode while gliding with a front foil in a locked position.

In some general aspects, a hydrofoil device may comprise a front wing may include a convex upper surface, a concave lower surface, a front wing curved leading edge; a back wing including an upper surface, a lower surface, a back wing curved leading edge; a fuselage including an elongated body with a recess on a forward portion of the elongated body, wherein the front wing fits within the recess and is connected to a forward portion of the elongated body within the recess and the back wing is connected to an aft portion of the elongated body, a hinge connecting a portion of one or both the convex upper surface and the front wing curved leading edge to the recess, wherein the hinge allows the front wing to pivot within a predefined range; and a strut connected perpendicular to the elongated body, wherein the strut is connectable to a surfboard.

Implementations may include one or more of the following features. In some aspects, the back wing further may include a hinge. In some embodiments, the hinge may be manually adjustable to control an angle of the back wing to the fuselage. In some implementations, the hinge may allow the back wing to fluctuate within a predefined angle range of the back wing to the fuselage depending on one or both a position or motion of the hydrofoil device within water. In some aspects, the front wing may include flexible hydrons. In some implementations, at least a portion of the hydrofoil device may include a buoyant material. In some aspects, the fuselage may comprise carbon fiber. In some embodiments, at least a portion of one or both the front wing and the back wing may include a semi-flexible material. In some implementations, the back wing may include a concave upper surface and a convex lower surface.

In some general aspects, a hydrofoil system may comprise a surfboard; a hydrofoil device may include a front wing that may include a convex upper surface, a concave lower surface, a front wing curved leading edge; a back wing may include an upper surface, a lower surface, a back wing curved leading edge; a fuselage may include an elongate body with a recess on a forward portion of the elongate body, wherein the front wing fits within the recess and is connected to a forward portion of the elongate body within the recess and the back wing is connected to an aft portion of the elongate body, a hinge connecting a portion of one or both the convex upper surface and the front wing curved leading edge to the recess, wherein the hinge allows the front wing to pivot within a predefined range; and a strut connected perpendicular to the elongate body; and a base connecting the strut to the surfboard, wherein the strut connects perpendicular to the surfboard.

Implementations may include one or more of the following features. In some aspects, the strut further may include a hinge mechanism that connects the strut to the fuselage. In some embodiments, the base of the strut may comprise a saddle shape. In some implementations, the surfboard may be comprised of a foam core. In some embodiments, the surfboard may comprise a stand-up paddleboard. In some embodiments, the surfboard may include one or more channels located at the distal end of the surfboard. In some aspects, the strut may comprise a teardrop shape. In some implementations, the back wing many further include a hinge, which may be manually adjustable to control an angle of the back wing to the fuselage. In some aspects, the hinge may allow the back wing to fluctuate within a predefined angle range of the back wing to the fuselage depending on one or both a position or motion of the hydrofoil device within water. In some implementations, the hinge further may include a reinforcement region that stabilizes and strengthens the connection between the front wing and the fuselage.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

The present disclosure provides generally for a hydrofoil system that may allow a surfboard to glide above the water surface. According to the present disclosure, a rider may be able to manipulate a hydrofoil device attached to a surfboard with limited training and athletic ability.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Surfboard: as used herein refers to any watercraft device that may be ridden by an individual. As non-limiting examples, a surfboard may comprise a surfboard, a boogie board, a catamaran, a trimaran, a stand-up paddleboard, a canoe, a paddleboat, a raft, a rowboat, or other watercraft vessel capable of being ridden and operated by an individual.

Boat: as used herein refers to any watercraft device that may be ridden by a plurality of people. As non-limiting examples, a boat may comprise a catamaran, a trimaran, a raft, a canoe, a paddleboat, a rowboat, a ferry, or other watercraft vessel capable of being ridden by multiple people.

Hydron: as used herein refers to a hinged surface on a trailing edge of a wing in a hydrofoil, wherein the hinged surface may provide lateral balance control. In some aspects, a hydron may be a hydrofoil equivalent to an aileron, which may be typical of fixed-wing aircrafts.

Figure 1:
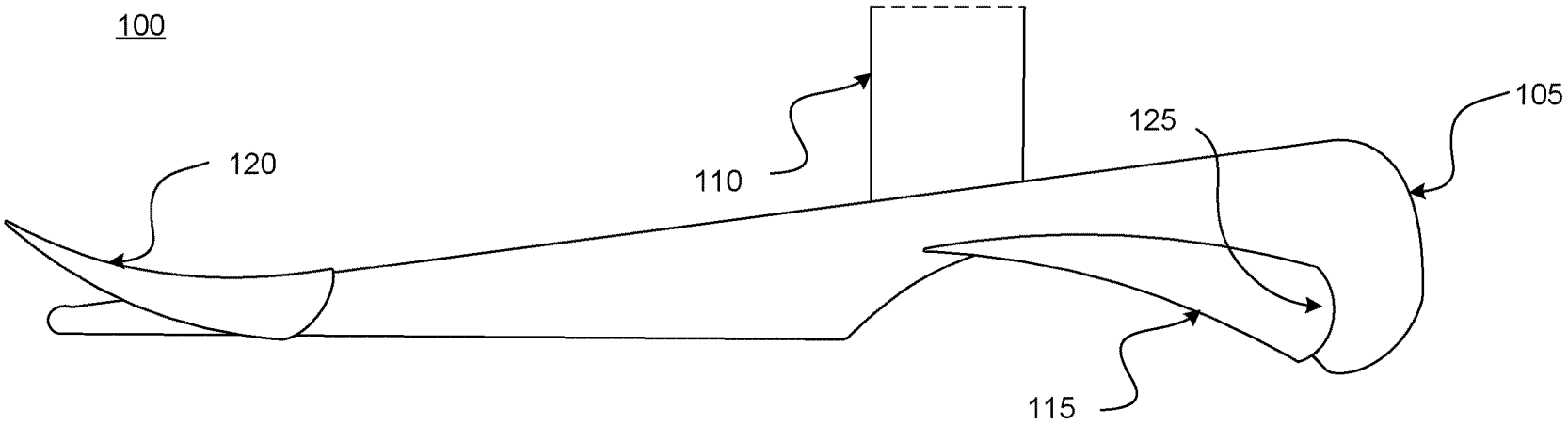
FIG. 1 illustrates an exemplary hydrofoil device, according to some embodiments of the present disclosure.

Referring now to FIG. 1, an exemplary hydrofoil device 100 is illustrated. In some aspects, the hydrofoil device 100 may comprise a fuselage 105 that may be connected to a surfboard (not shown) by a strut 110. In some embodiments, the hydrofoil device 100 may comprise a front wing 115 and a back wing 120. In some implementations, the front wing 115 may be connected to the fuselage 105 at a hinge point 125. In some embodiments, the back wing 120 may comprise a concave upper surface, which may direct water flow quickly allowing for a faster lift. In some aspects, components of a hydrofoil device may be comprised of a single material or combination of materials, such as polymer foam, wood, fiberglass, carbon fiber, composite, or any other known or convenient materials. In some embodiments, a portion of the hydrofoil device 100 may comprise a buoyant material, which may enhance stability.

In some embodiments, riders may have the ability to choose different models based on level of experience. For example, for children or first-time riders, the hydrofoil device 100 may comprise components with soft edges and materials that may not cause significant damage to other swimmers. As another example, for experienced riders, the hydrofoil device 100 may comprise carbon fiber components to allow for higher speeds.

Figure 2:
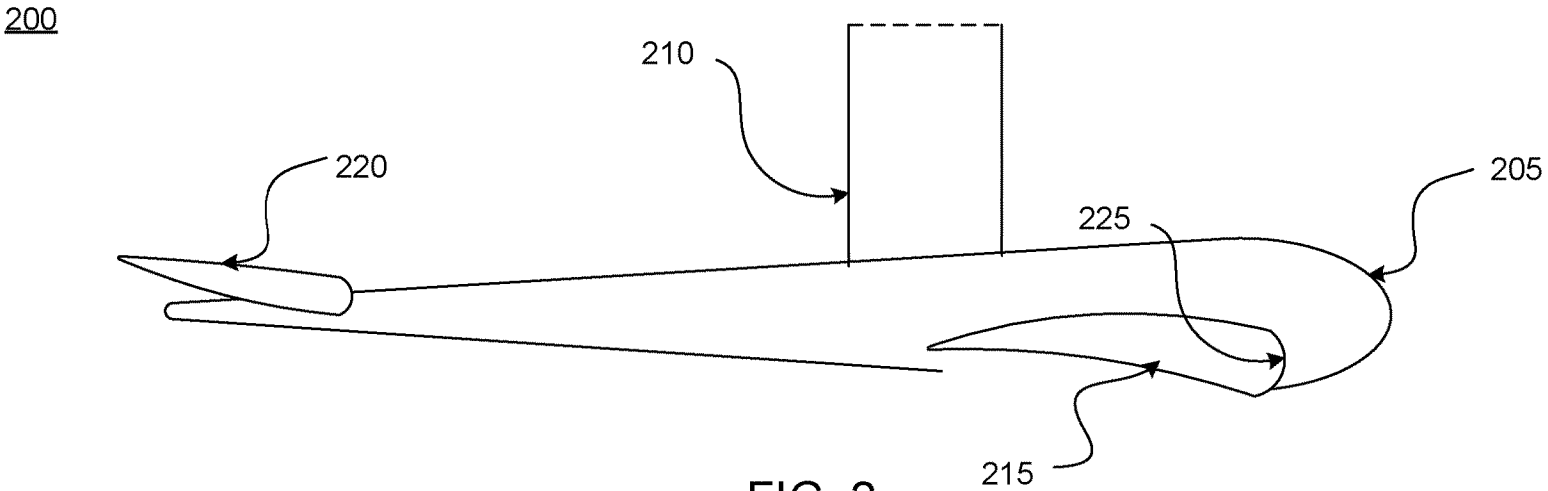
FIG. 2 illustrates an alternate exemplary hydrofoil device, according to some embodiments of the present disclosure.

Referring now to FIG. 2, an alternate exemplary hydrofoil device 200 is illustrated. In some embodiments, the hydrofoil device 200 may comprise a fuselage 205 that may be connected to a surfboard (not shown) by a strut 210. In some aspects, the hydrofoil device 200 may comprise a front wing 215 and a back wing 220. In some implementations, the front wing 215 may be connected to the fuselage 205 at a hinge point 225. In some embodiments, the back wing 220 may comprise a flat upper surface, which may direct water flow more slowly that a curved surface allowing for a slower lift. In some aspects, a slower lift may allow for easier control of the hydrofoil device 200.

Figure 3A:
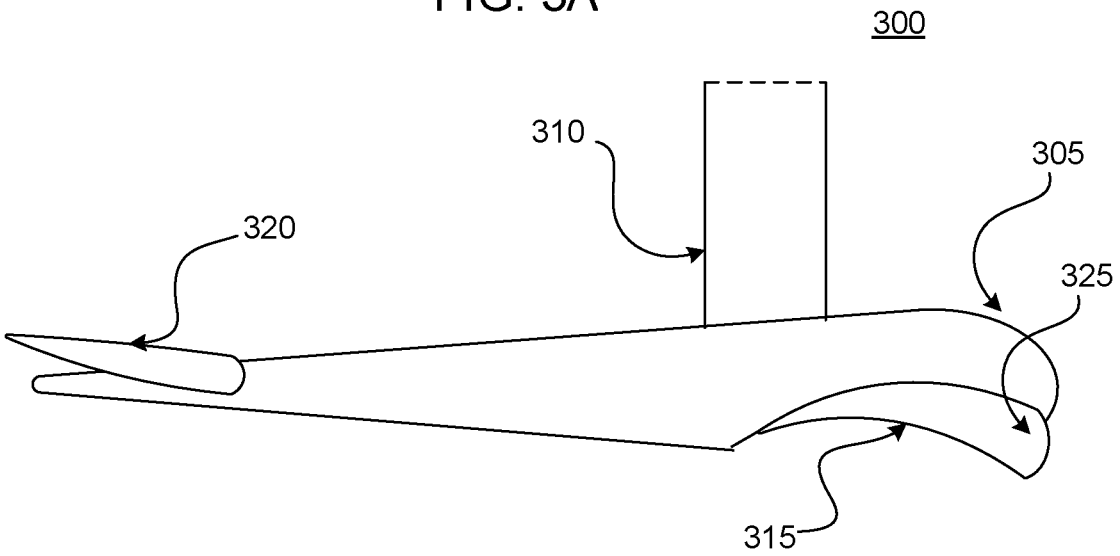
FIG. 3A illustrates an exemplary hydrofoil device in a resting state, according to some embodiments of the present disclosure.
Figure 3B:
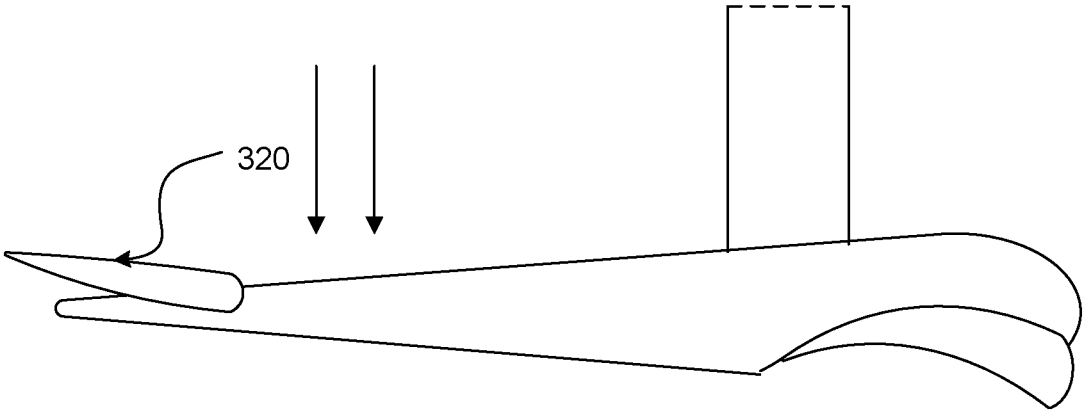
FIG. 3B illustrates an exemplary hydrofoil device in a downward state, according to some embodiments of the present disclosure.
Figure 3C:
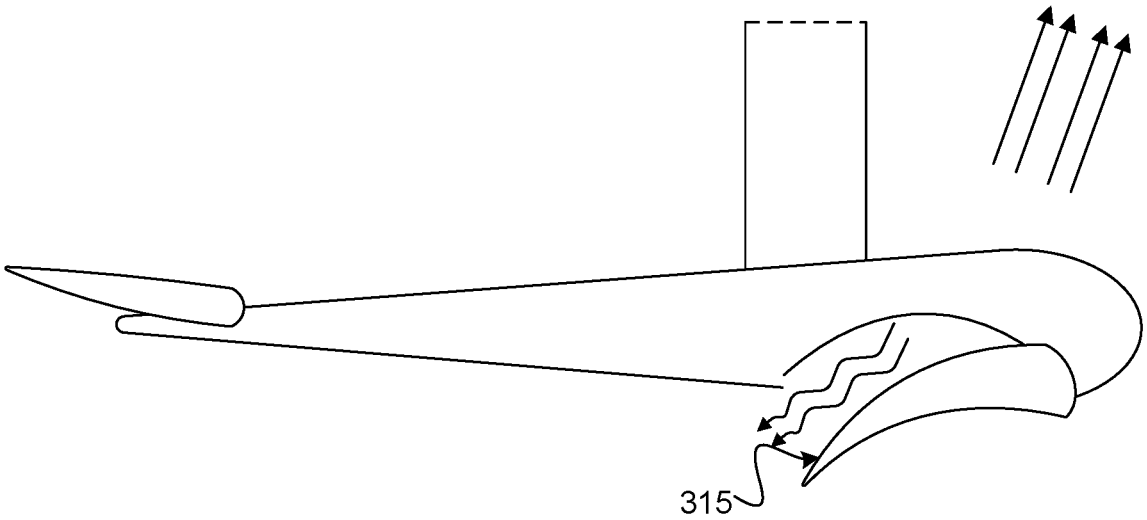
FIG. 3C illustrates an exemplary hydrofoil device in a lifting state, according to some embodiments of the present disclosure.

Referring now to FIGS. 3A-3C, an exemplary hydrofoil device 300 is illustrated in a range of states in the water. In some aspects, a hydrofoil device 300 may comprise a fuselage 305 with a back wing 320 and front wing 315. In some embodiments, the fuselage 305 may comprise an elongated body with a recess, wherein the front wing 315 may fit under the recess. In some implementations, the front wing 315 may be attached to the fuselage 305 by a hinge 325, which may allow the front wing 315 to pivot within a predefined range. In some embodiments, the fuselage 305 may be connected to a strut 310 that may extend perpendicular from the elongated body, wherein the strut 310 may connect the hydrofoil device 300 to a surfboard (not shown).

In some aspects, such as illustrated in FIG. 3A, in a resting position, the front wing 315 may be located within the recess. In some embodiments, such as illustrated in FIG. 3B, when downward pressure is placed on the hydrofoil device 300, the hydrofoil device 300 may thrust downward and water may flow over the back wing 320, which may cause the hydrofoil device 300 to lift within the water. In some implementations, such as illustrated in FIG. 3C, the lift may cause the front wing 315 to pivot away from the fuselage 305, which may cause the water to flow over the front wing 315, and the water flow may propel the hydrofoil device 300 forward. In some aspects, the rider may provide the balance weight to prevent the hydrofoil device 300 from rising above the water level.

Figure 4A:
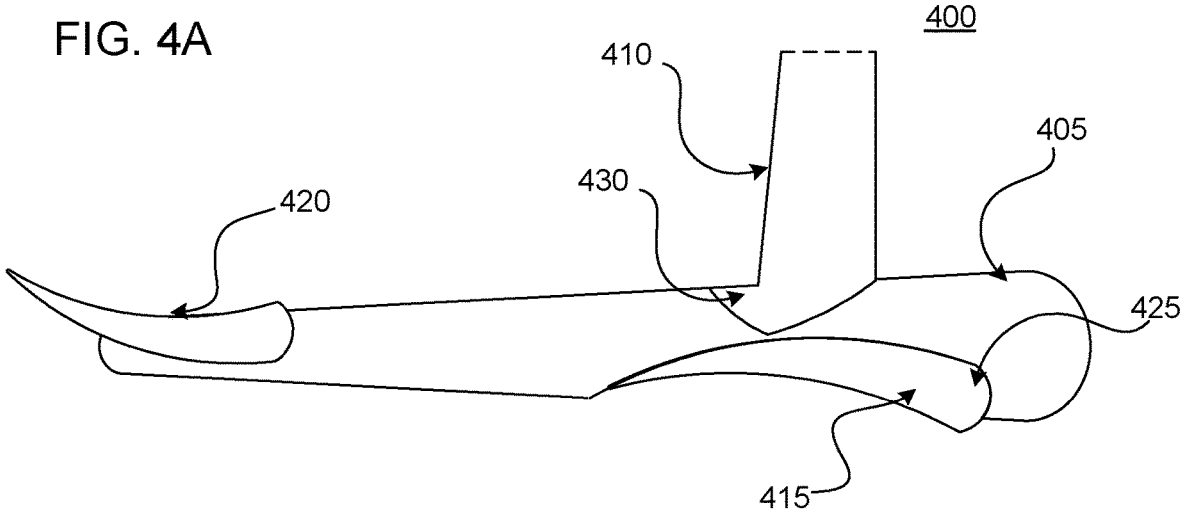
FIG. 4A illustrates an exemplary hydrofoil device in a resting state, according to some embodiments of the present disclosure.
Figure 4B:
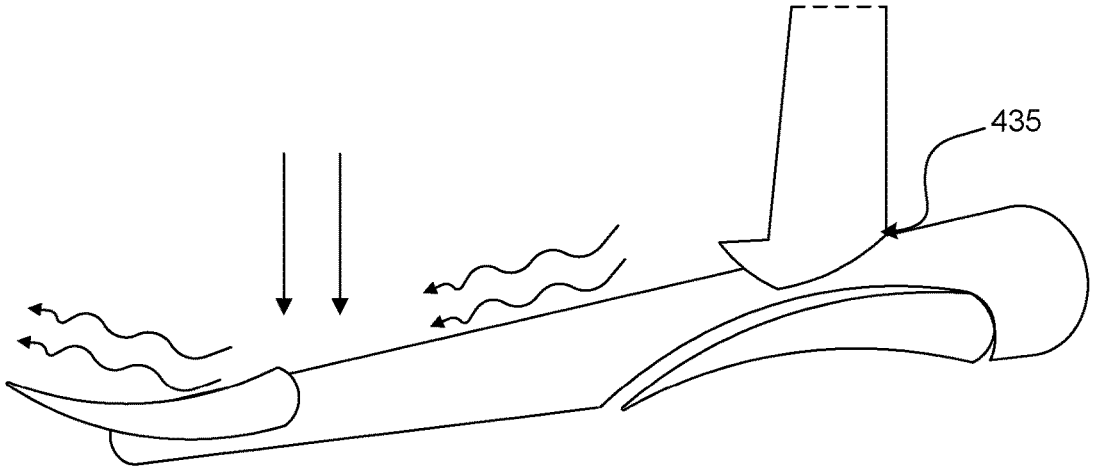
FIG. 4B illustrates an exemplary hydrofoil device in a downward state, according to some embodiments of the present disclosure.
Figure 4C:
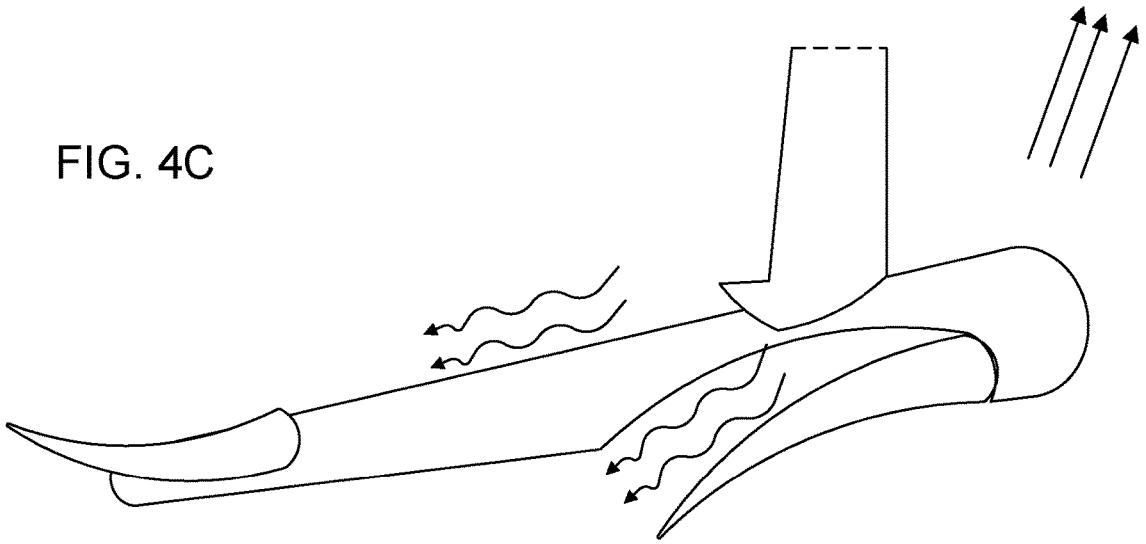
FIG. 4C illustrates an exemplary hydrofoil device in a lifting state, according to some embodiments of the present disclosure.

Referring now to FIGS. 4A-4C, an alternate exemplary hydrofoil device 400 is illustrated in a range of states in the water. In some aspects, a hydrofoil device 400 may comprise a fuselage 405 with a back wing 420 and front wing 415. In some embodiments, the fuselage 405 may comprise an elongated body with a recess, wherein the front wing 415 may fit under the recess. In some implementations, the front wing 415 may be attached to the fuselage 405 by a hinge 425, which may allow the front wing 415 to pivot within a predefined range.

In some embodiments, the fuselage 405 may be connected to a strut 410 that may extend perpendicular from the elongated body, wherein the strut 410 may connect the hydrofoil device 400 to a surfboard (not shown). In some aspects, the strut 410 may comprise a saddle base 430 connected to the fuselage 405 by a strut hinge 435. In some implementations, the saddle base 430 may provide stability and increase the surface area for the strut hinge 435, which may increase durability. In some embodiments, the strut hinge 435 may replace the front wing hinge 425, wherein the front wing 415 may be stationary.

In some aspects, such as illustrated in FIG. 4A, in a resting position, the front wing 415 may be located within the recess. In some embodiments, such as illustrated in FIG. 4B, when downward pressure is placed on the hydrofoil device 400, the hydrofoil device 400 may thrust downward and water may flow over the back wing 420, which may cause the fuselage 405 to pivot at the strut hinge 435. The speed of the water flow over the back wing 420 may increase, which may cause the hydrofoil device 400 to lift within the water. In some implementations, such as illustrated in FIG. 4C, the lift may cause the front wing 415 to pivot away from the fuselage 405, which may cause the water to flow over the front wing 415, and the water flow may propel the hydrofoil device 400 forward. In some aspects, the rider may provide the balance weight to prevent the hydrofoil device 400 from rising above the water level.

Figure 5A:
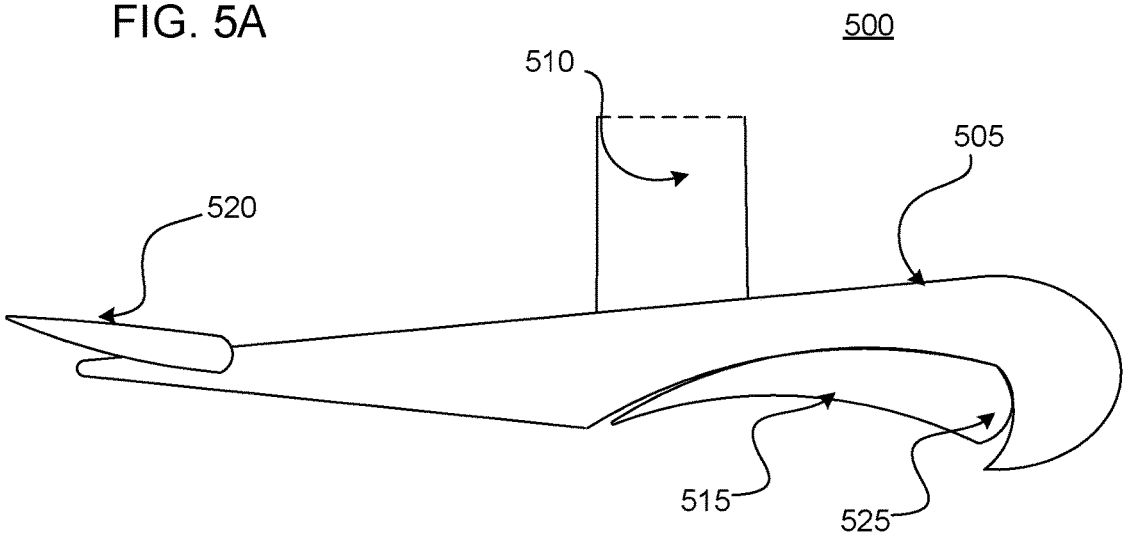
FIG. 5A illustrates an exemplary hydrofoil device in a resting state, according to some embodiments of the present disclosure.
Figure 5B:
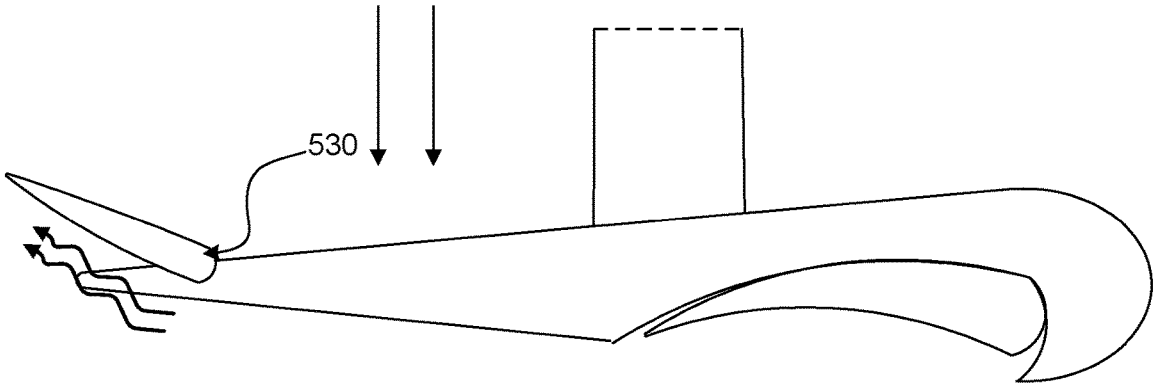
FIG. 5B illustrates an exemplary hydrofoil device in a downward state, according to some embodiments of the present disclosure.
Figure 5C:
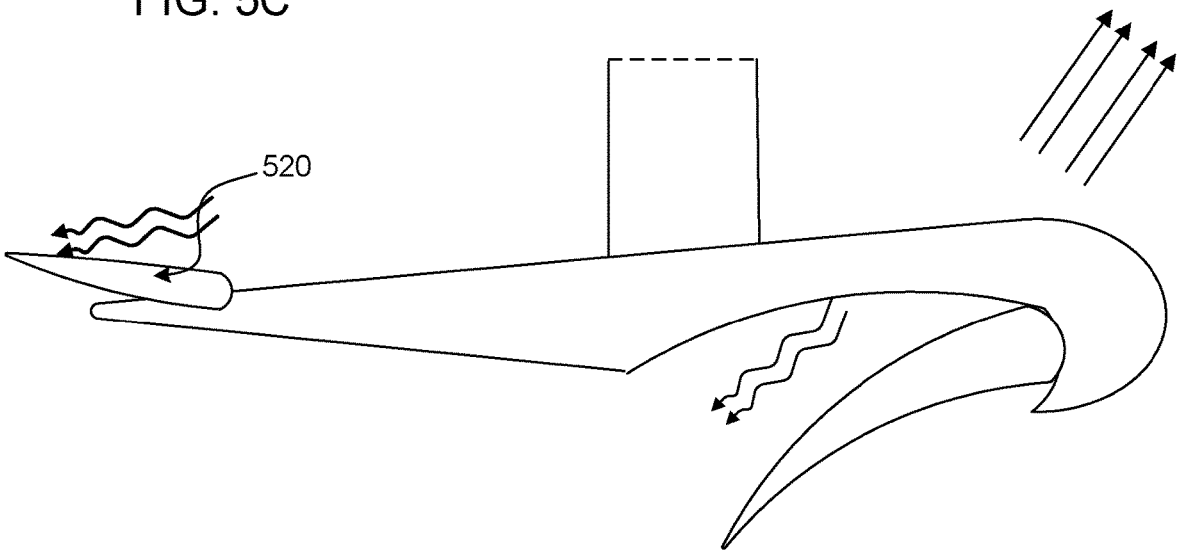
FIG. 5C illustrates an exemplary hydrofoil device in a lifting state, according to some embodiments of the present disclosure.

Referring now to FIGS. 5A-5C, an alternate exemplary hydrofoil device 500 is illustrated in a range of states in the water. In some aspects, a hydrofoil device 500 may comprise a fuselage 505 with a back wing 520 and front wing 515. In some embodiments, the fuselage 505 may comprise an elongated body with a recess, wherein the front wing 515 may fit under the recess. In some implementations, the front wing 515 may be attached to the fuselage 505 by a front hinge 525, which may allow the front wing 515 to pivot within a predefined range. In some embodiments, the back wing 520 may be attached to the fuselage 505 by a back hinge 530, which may allow the back wing 520 to pivot within a predefined range. In some embodiments, the fuselage 505 may be connected to a strut 510 that may extend perpendicular from the elongated body, wherein the strut 510 may connect the hydrofoil device 500 to a surfboard (not shown).

In some aspects, such as illustrated in FIG. 5A, in a resting position, the front wing 515 may be located within the recess. In some embodiments, such as illustrated in FIG. 5B, when downward pressure is placed on the hydrofoil device 500, the hydrofoil device 500 may thrust downward and water may flow under the back wing 520, which may initially cause the back wing 520 to pivot increasing the speed of water flow under the back wing 520, which may cause the hydrofoil device 500 to lift within the water. In some implementations, such as illustrated in FIG. 5C, the lift may cause the back wing 520 to lower, and the front wing 515 to pivot away from the fuselage 505, which may cause the water to flow over the front wing 515. The water flow may propel the hydrofoil device 500 forward. In some aspects, the rider may provide the balance weight to prevent the hydrofoil device 500 from rising above the water level.

Figure 6:
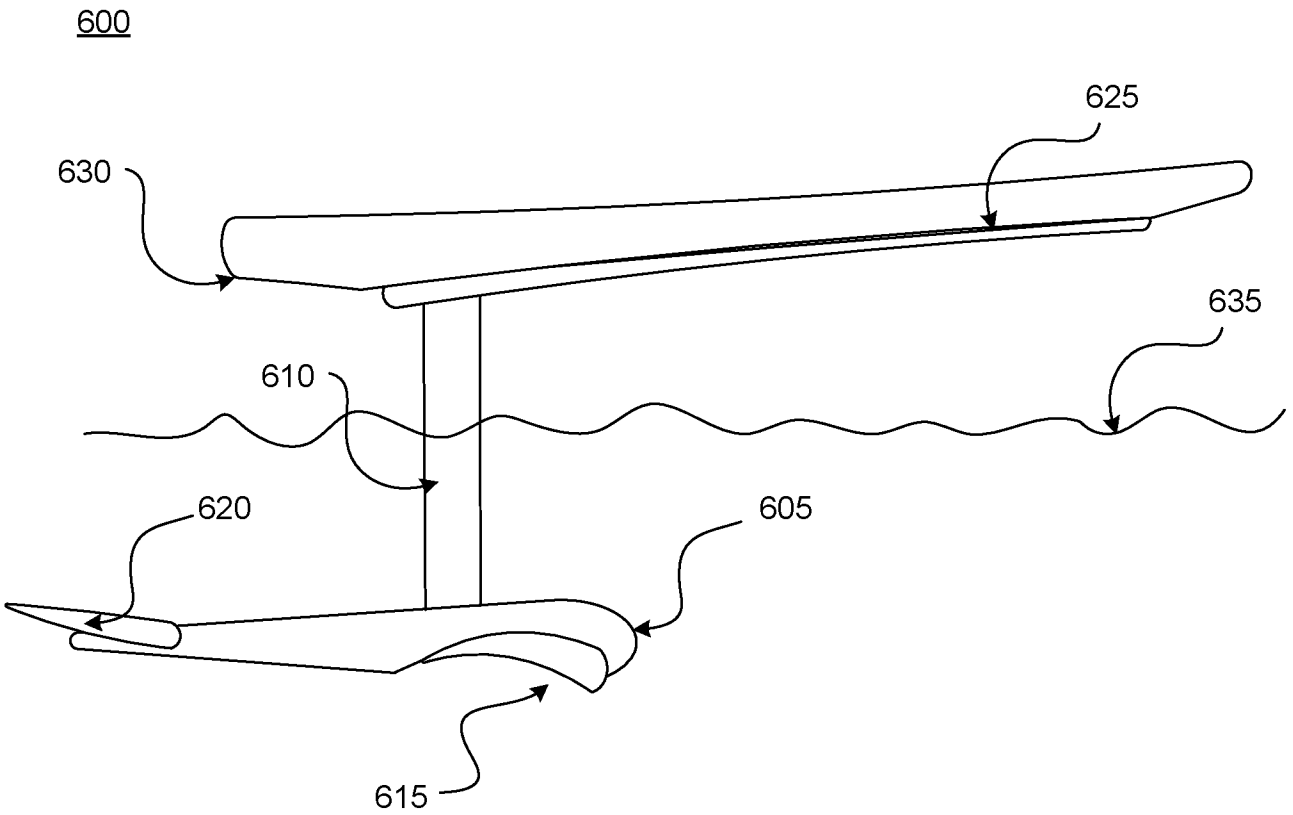
FIG. 6 illustrates an exemplary hydrofoil system, according to some embodiments of the present disclosure.

Referring now to FIG. 6, an exemplary hydrofoil system 600 is illustrated, wherein the hydrofoil system 600 comprises a hydrofoil device 605-620 connected to a surfboard 630. In some aspects, the hydrofoil device 605-620 may connect to the surfboard 630 through a base 625 attached to the surfboard 630. In some embodiments, the base 625 may be configured to accept the strut 610. In some implementations, the base 625 may extend for a portion of the surfboard 630, which may increase the stability of the hydrofoil system 600. In some aspects, the hydrofoil system 600 may allow the surfboard 630 to hover above the water line 635 as the hydrofoil device 605-620 propels through the water. In some aspects, the surfboard may comprise polyurethane or polystyrene foam covered with layers of fiberglass cloth, a polyester or epoxy resin, carbon fiber, or Kevlar composites, as non-limiting examples. In some embodiments, one or more components of the hydrofoil system 600 may be molded, such as with a foam or resin, or machined, such as with wood.

Figure 7A:
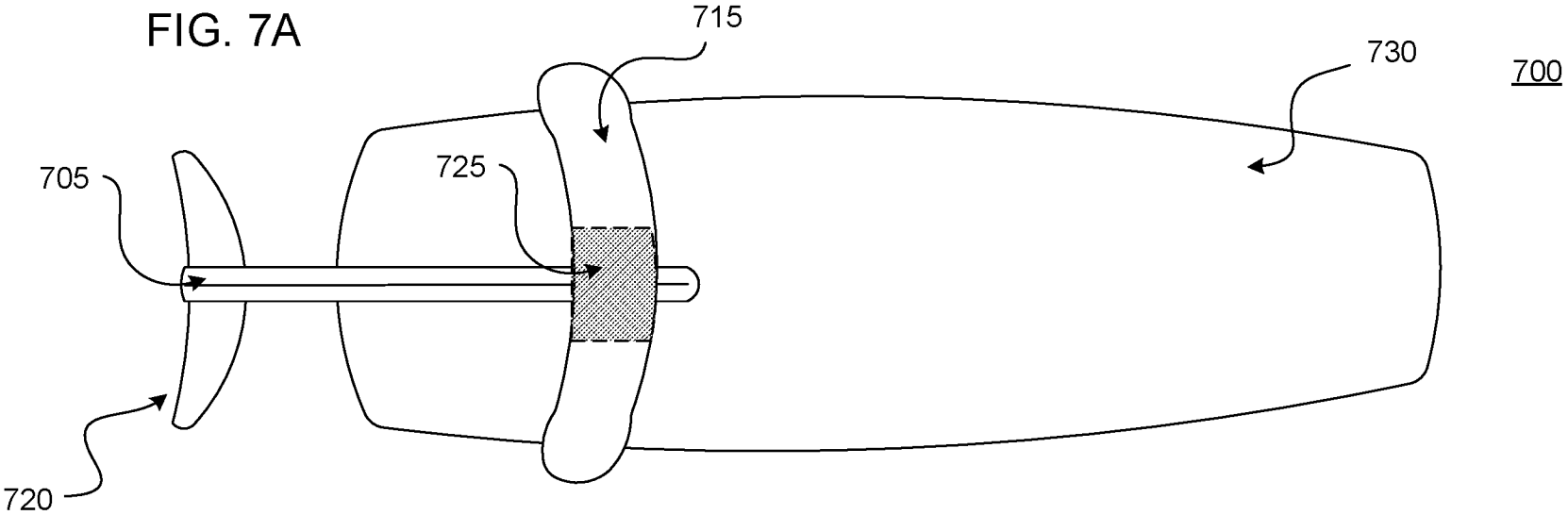
FIG. 7A illustrates a bottom-up view of an exemplary hydrofoil system, according to some embodiments of the present disclosure.
Figure 7B:
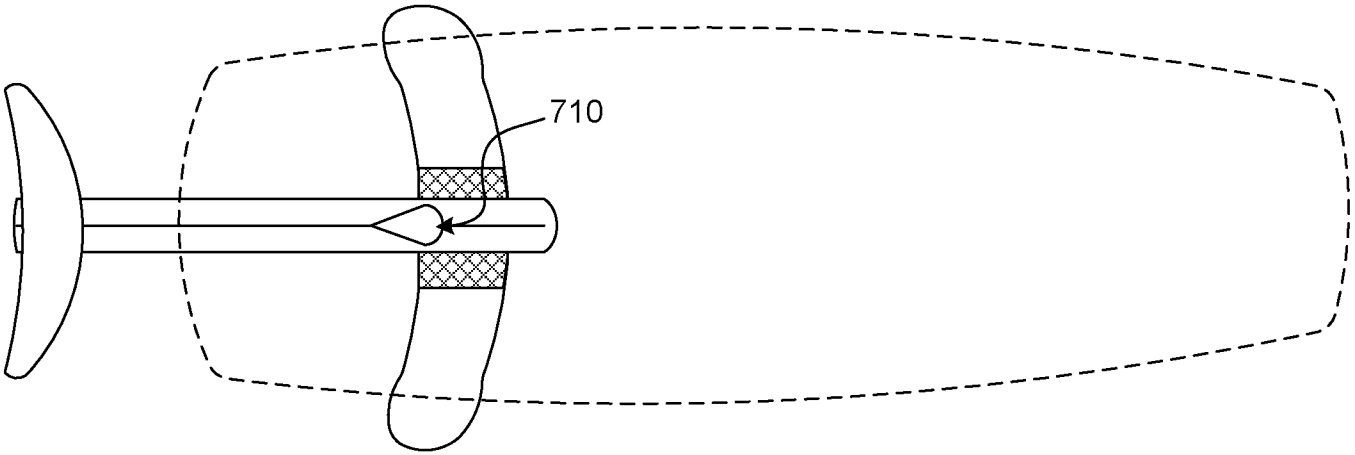
FIG. 7B illustrates a top-down view of an exemplary hydrofoil system, according to some embodiments of the present disclosure.

Referring now to FIGS. 7A and 7B, a bottom-up view of an exemplary hydrofoil system 700 and a top-down view of an exemplary hydrofoil system 700 are illustrated, respectively. In some aspects, the hydrofoil system 700 may comprise a fuselage 705 that runs parallel to a surfboard 730 when connected through a strut 710 that may run perpendicular to one or both the fuselage 705 and surfboard 730. In some embodiments, the hydrofoil system 700 may further comprise a front wing 715 and a back wing 720, wherein the front wing 715 may connect to the lower surface of the fuselage 705 by a hinge 725. In some implementations, the hinge 725 may extend beyond the hinge point, which may increase durability and longevity of the hinge mechanism.

Figure 8A:
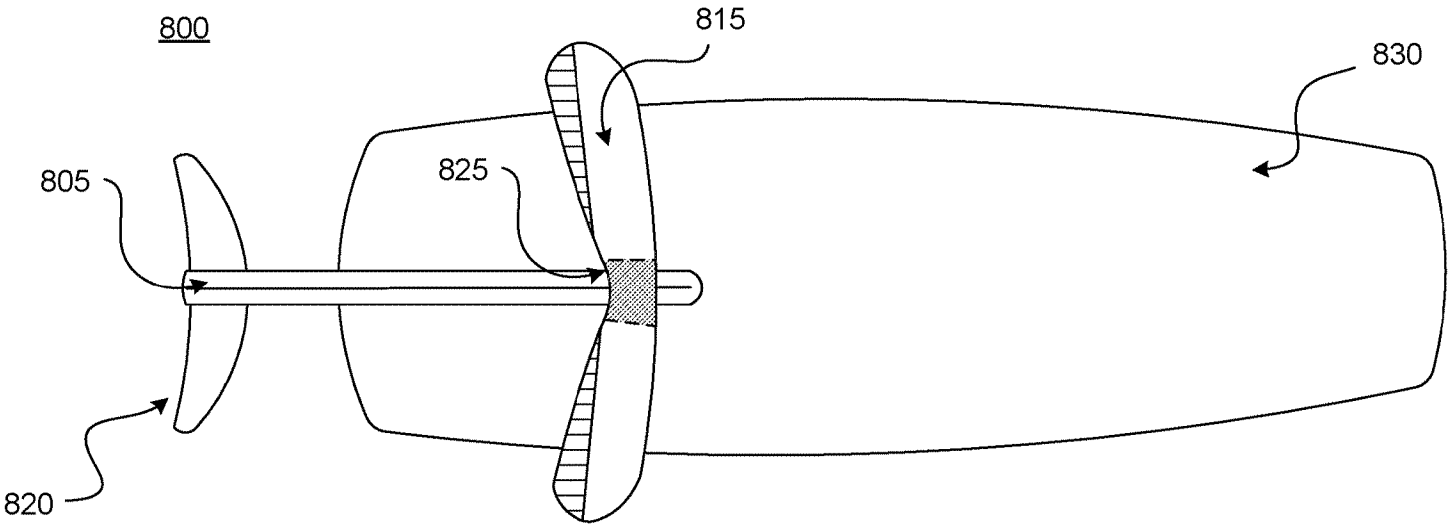
FIG. 8A illustrates a bottom-up view of an alternate exemplary hydrofoil system, according to some embodiments of the present disclosure.
Figure 8B:
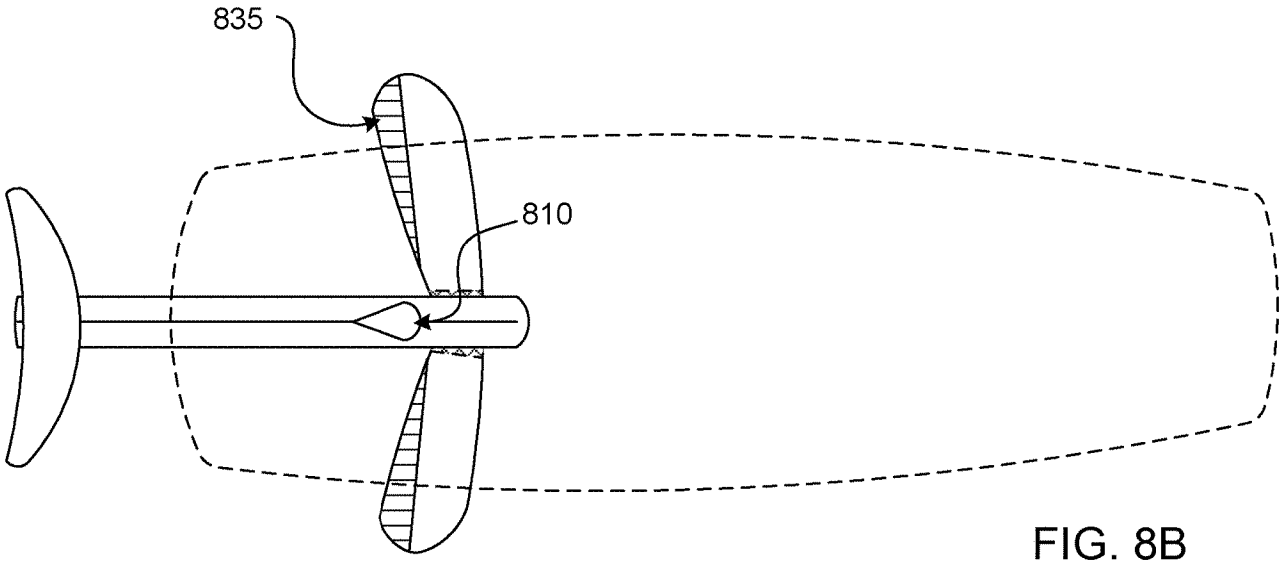
FIG. 8B illustrates a top-down view of an alternate exemplary hydrofoil system, according to some embodiments of the present disclosure.

Referring now to FIGS. 8A and 8B, a bottom-up view of an alternate exemplary hydrofoil system 800 and a top-down view of an alternate exemplary hydrofoil system 800 are illustrated, respectively. In some aspects, the hydrofoil system 800 may comprise a fuselage 805 that runs parallel to a surfboard 830 when connected through a strut 810 that may run perpendicular to one or both the fuselage 805 and surfboard 830. In some embodiments, the hydrofoil system 800 may further comprise a front wing 815 and a back wing 820, wherein the front wing 815 may connect to the lower surface of the fuselage 805 by a hinge 825. In some aspects, the front wing 815 may comprise flexible hydrons 835, which may increase hydrodynamics of the front wing 815 as it glides through water.

In some aspects, the surfboard may comprise a trimaran, with holes running along the longitudinal axis on both sides of the center pontoon, such that the entire surfboard 830 or at least a portion of the surfboard 830 may be momentarily plunged below the surface of the water to enable a longer stroke needed to pump the forward wings and thus accelerate the foil while in take-off mode. Once there is some speed the trimaran may be completely out of the water, and it may take much shallower pumps to maintain speed in the gliding and pumping phases.

Figure 9:
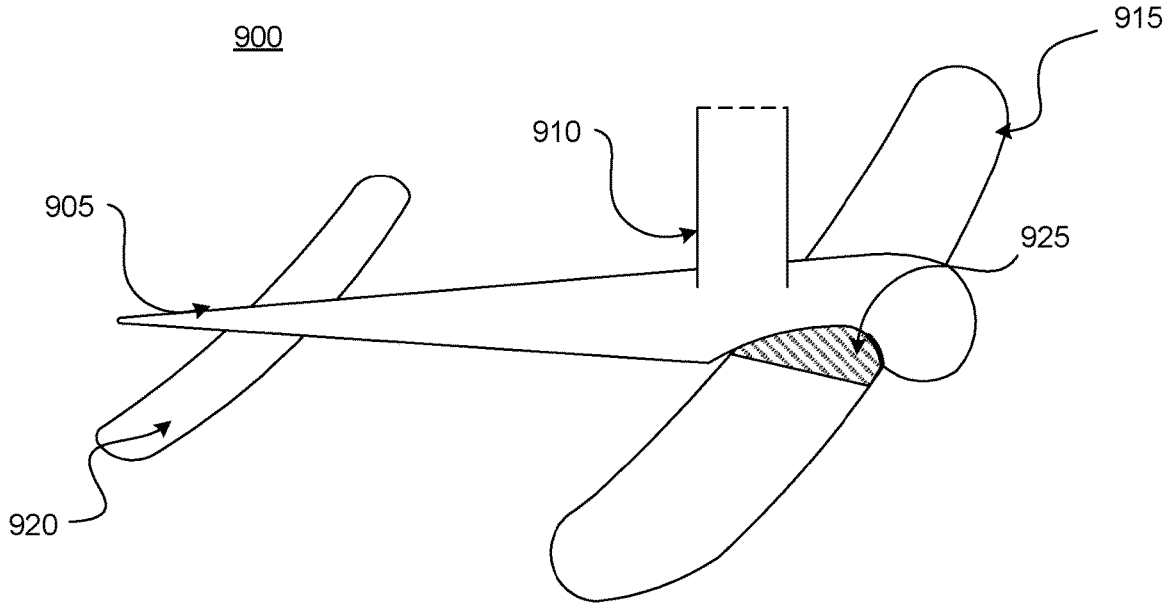
FIG. 9 illustrates a perspective view of an exemplary hydrofoil device, according to some embodiments of the present disclosure.

Referring now to FIG. 9, a perspective view of an exemplary hydrofoil device 900 is illustrated. In some aspects, the hydrofoil device 900 may comprise a fuselage 905 connected to a strut 910, which may extend perpendicular to the fuselage 905. In some embodiments, the hydrofoil device 900 may further comprise a back wing 920 attached to the upper surface of the fuselage 905, and a front wing 915 attached to the lower surface of the fuselage 905, wherein the front wing 915 may attach within a recess by a hinge 925.

Figure 10:
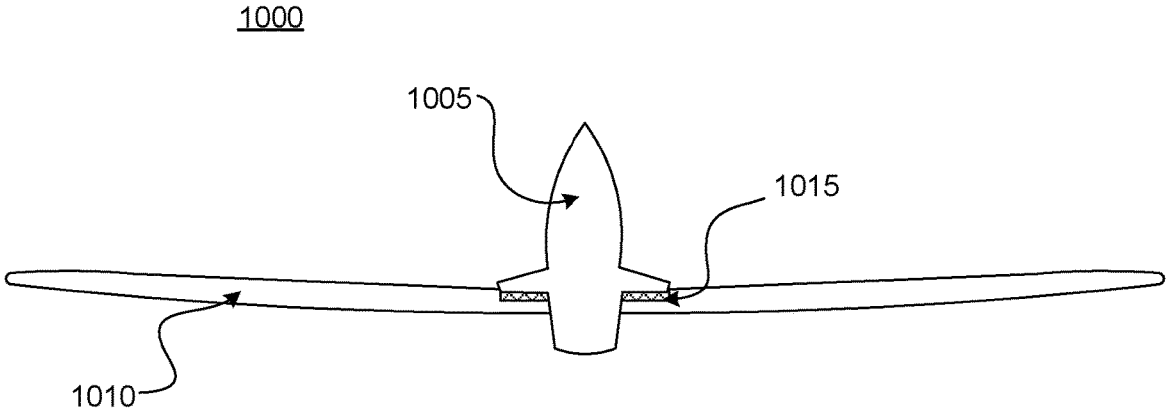
FIG. 10 illustrates a front view of an exemplary hydrofoil device, according to some embodiments of the present disclosure.

Referring now to FIG. 10, a front view of an exemplary hydrofoil device 1000 is illustrated. In some aspects, the hydrofoil device 1000 may comprise a front wing 1010, which may connect to the fuselage 1005 by a hinge 1015. In some embodiments, the fuselage 1005 may have a body shape similar to some fish, such as a tuna, marlin, el dorado, barracuda, as non-limiting examples, which may provide a hydrodynamic shape for glide through water.

Figure 11A:
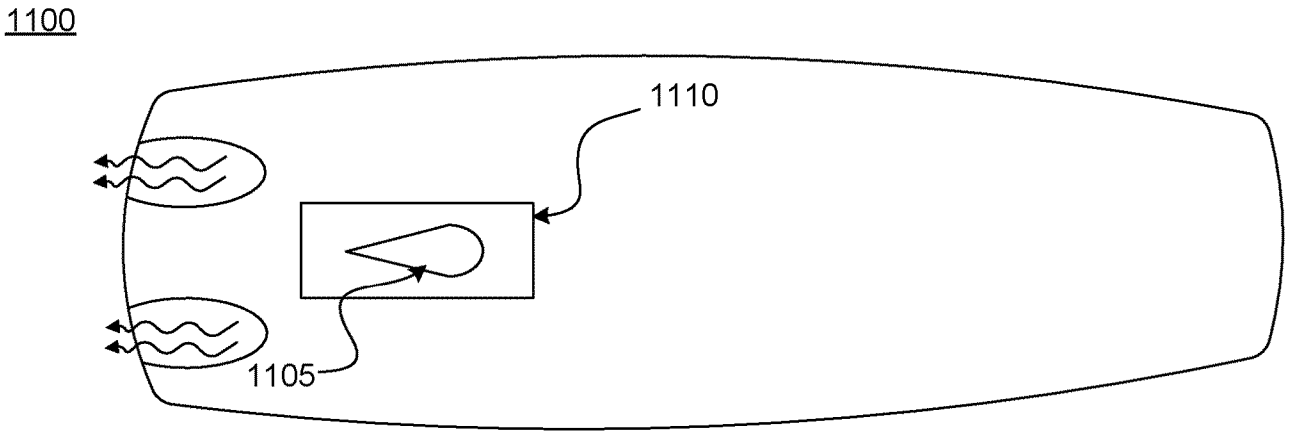
FIG. 11A illustrates a bottom-up view of an exemplary surfboard for a hydrofoil system, according to some embodiments of the present disclosure.
Figure 11B:
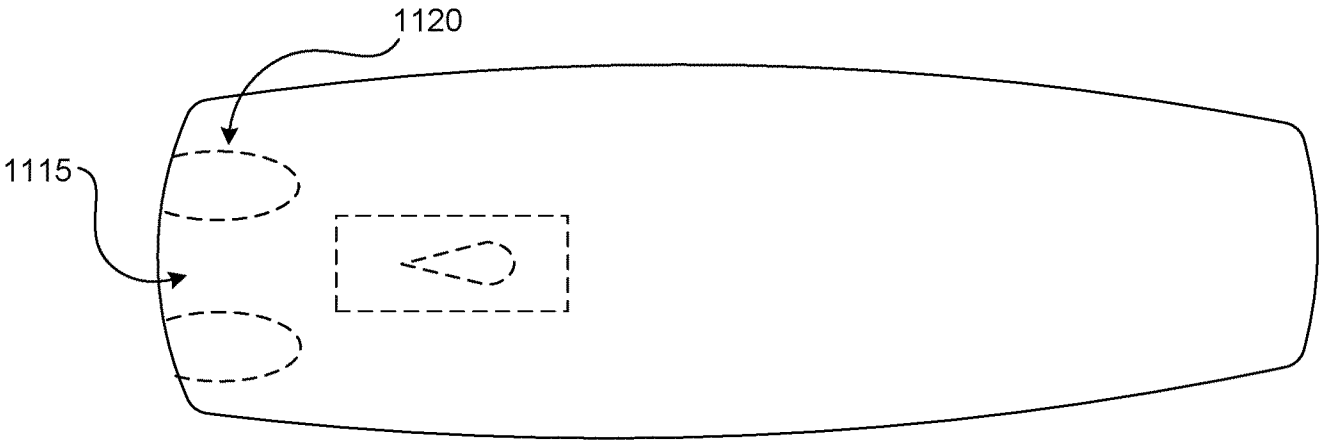
FIG. 11B illustrates a top-down view of an exemplary surfboard for a hydrofoil system, according to some embodiments of the present disclosure.

Referring now to FIGS. 11A and 11B, a bottom-up view of an exemplary surfboard 1115 for a hydrofoil system 1100 and a top-down view of an exemplary surfboard 1115 for a hydrofoil system 1100 are illustrated, respectively. In some aspects, a surfboard 1115 may comprise channels 1120 that may guide water flow through the channels as the hydrofoil system 1100 may gain momentum, until the surfboard 1115 may be lifted above the water line. In some embodiments, the surfboard 1115 may connect to the hydrofoil device, such as illustrated in FIGS. 1-2, through a strut 1105 that may extend perpendicular to the surfboard 1115, wherein the strut 1105 may be secured to the surfboard 1115 through a base 1110.

Figure 12A:
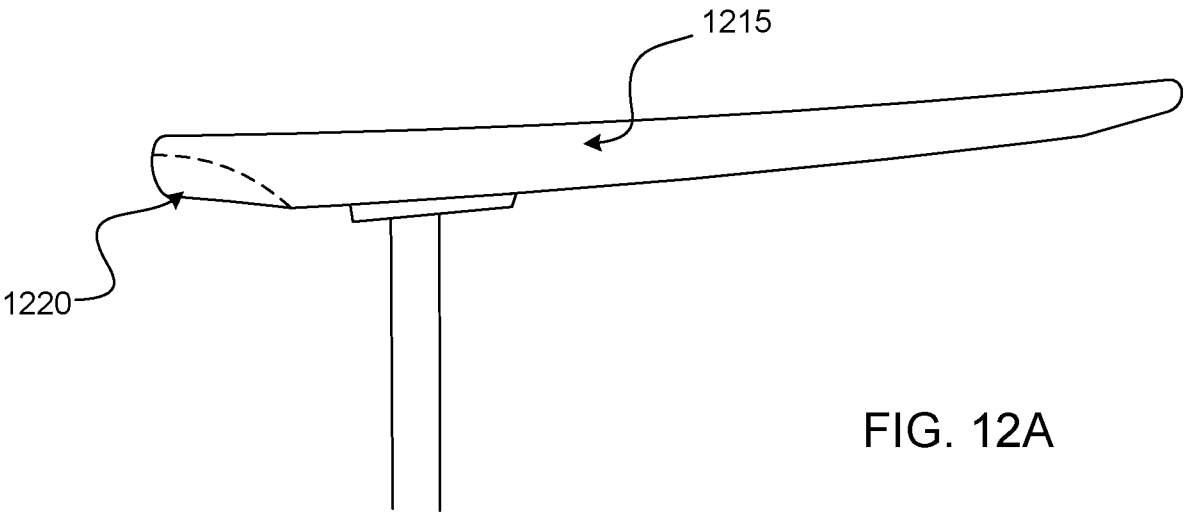
FIG. 12A illustrates a side view of an exemplary surfboard for a hydrofoil system, according to some embodiments of the present disclosure.
Figure 12B:
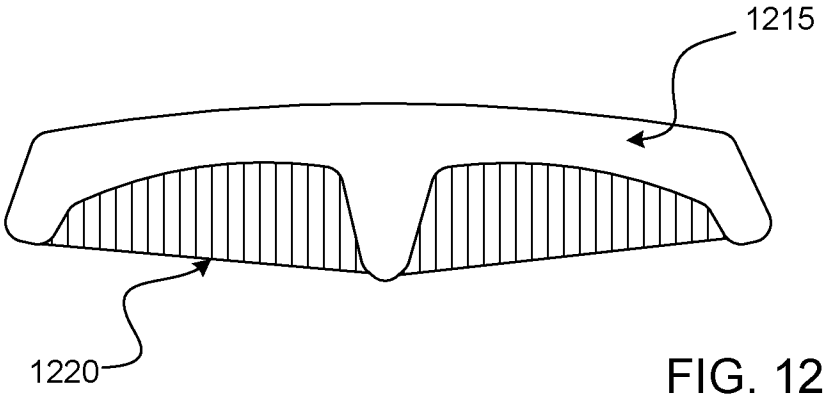
FIG. 12B illustrates a back view of an exemplary surfboard for a hydrofoil system, according to some embodiments of the present disclosure.

Referring now to FIGS. 12A and 12B, a side view of an exemplary surfboard 1215 for a hydrofoil system and a back view of an exemplary surfboard 1215 for a hydrofoil system are illustrated, respectively. In some aspects, the surfboard 1215 may comprise channels 1220 located at the aft portion of the surfboard 1215. In some embodiments, the channels 1220 may comprise a grooved surface, which may increase the effectiveness of the channels 1220.

Figure 13A:
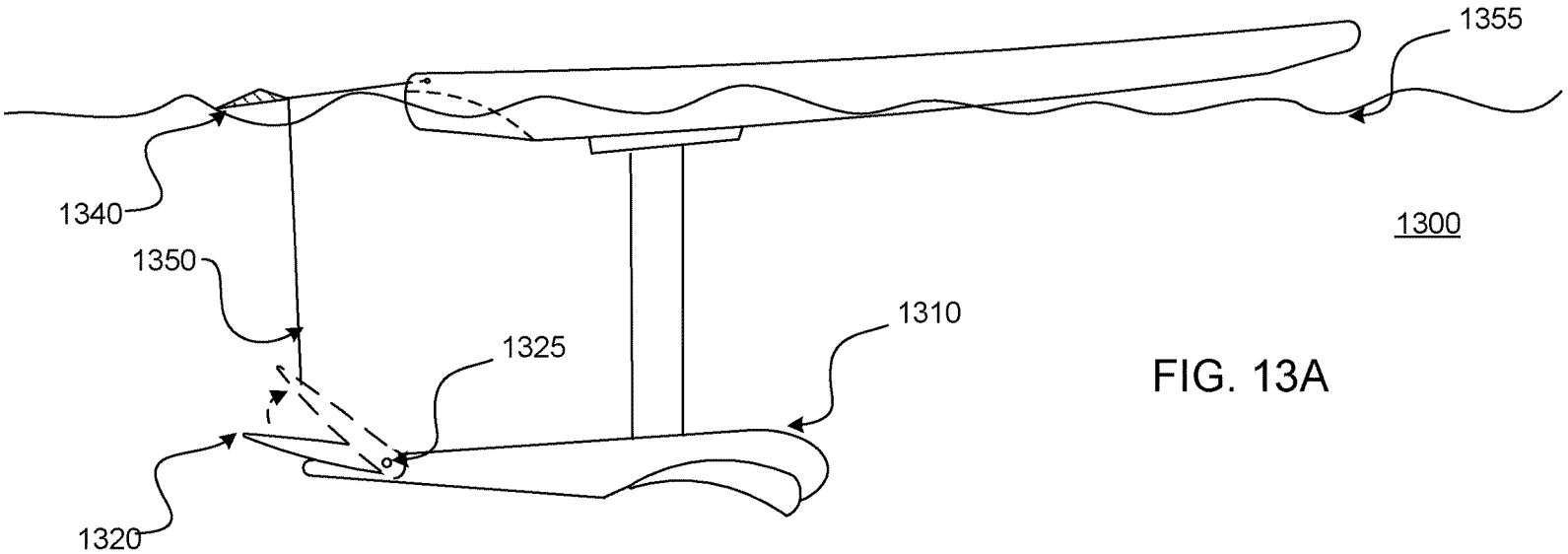
FIG. 13A illustrates an exemplary hydrofoil device with sensor in a resting state, according to some embodiments of the present disclosure.
Figure 13B:
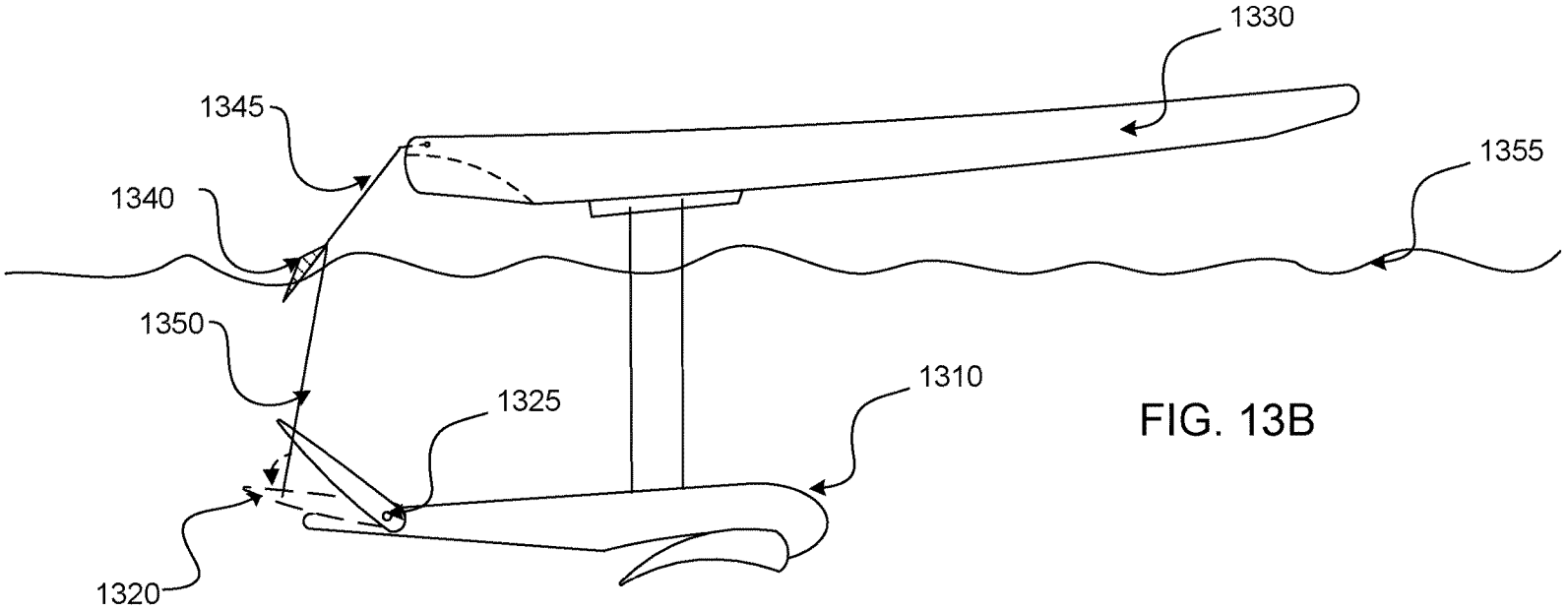
FIG. 13B illustrates an exemplary hydrofoil device with sensor in a lifting state, according to some embodiments of the present disclosure.

Referring now to FIGS. 13A and 13B, side views of an exemplary hydrofoil system 1300 with sensor 1340 are illustrated. In some aspects, a hydrofoil device 1310 may comprise a back wing 1320 that may be connected to the fuselage through a hinge 1325. In some embodiments, the angle of the back wing 1320 may be at least partially controlled by a sensor 1340, which may be connected to an aft portion of the surfboard 1330 through a connection line 1345.

In some implementations, a control line 1350 may extend from the sensor 1340 or the connection line 1345 to the back wing 1320. In some aspects (not shown), the sensor 1340 may control the position of the back wing 1320 through wireless communication, such as radio frequency (RF), infrared, Bluetooth, near field communication, or other wireless mechanisms.

In some aspects, such as illustrated in FIG. 13A, when the surfboard 1330 is in contact with the water surface 1355, the sensor 1340 may float on the water surface 1355 and may be positioned parallel to the surfboard 1330, which may draw the connection line 1345 up causing the back wing 1320 to pivot. Pulling the back wing 1320 up may cause the hydrofoil device 1310 to lift. In some aspects, such as illustrated in FIG. 13B, the lift may cause the surfboard 1330 to glide over the water surface 1355. As the surfboard 1330 rises out of the water, the connection line 1345 may shift to almost perpendicular as the sensor 1340 remains on the water surface 1355, which may lower the control line 1350 allowing the back wing 1320 to return to a neutral position.

Figure 14A:
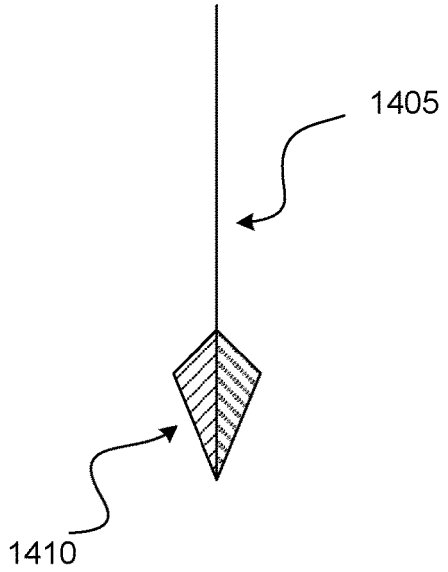
FIG. 14A illustrates a top-down view of an exemplary sensor for use in conjunction with a hydrofoil system, according to some embodiments of the present disclosure.
Figure 14B:
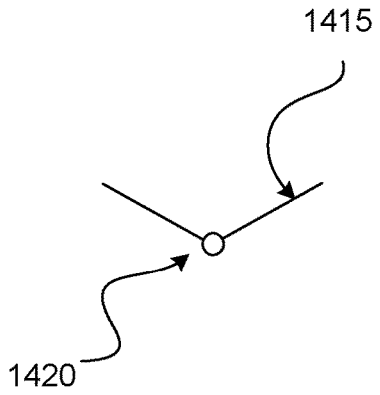
FIG. 14B illustrates a cross section view of an exemplary sensor for use in conjunction with a hydrofoil system, according to some embodiments of the present disclosure.
Figure 14C:
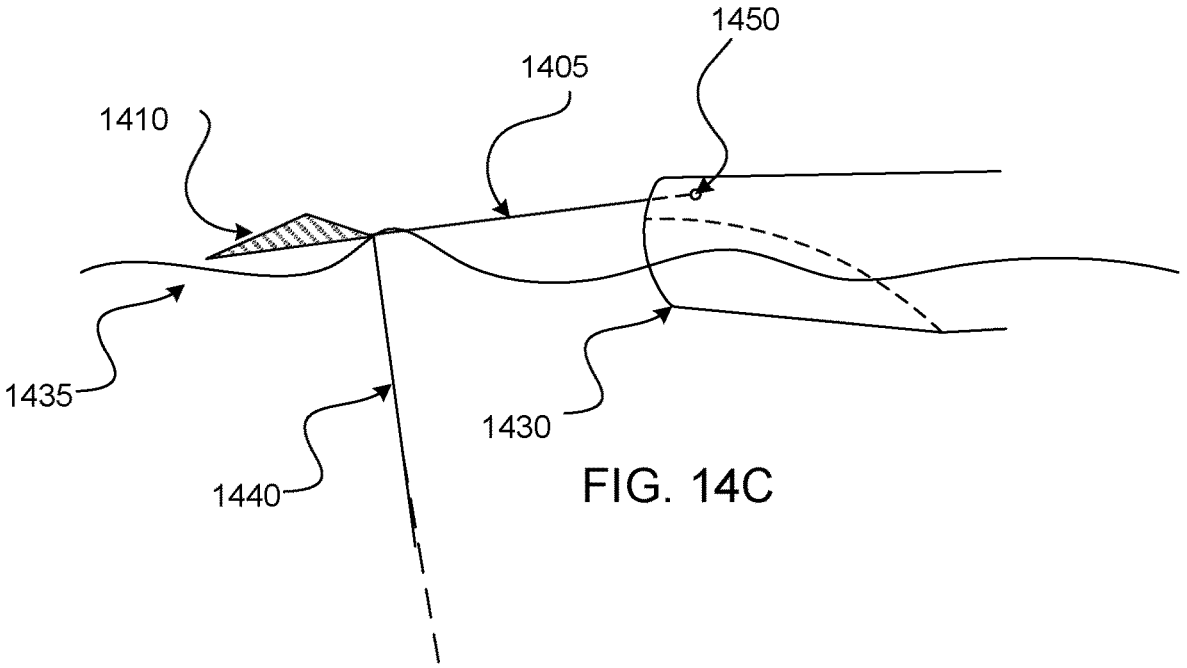
FIG. 14C illustrates a side view of an exemplary sensor for use in conjunction with a hydrofoil system, according to some embodiments of the present disclosure.

Referring now to FIGS. 14A-14C, various views of an exemplary sensor 1410 for use in conjunction with a hydrofoil system. In some aspects, the sensor 1410 may comprise an arrow shape, which may limit the drag effect the sensor 1410 may have on the hydrofoil system as it glides over a water surface 1435. In some embodiments, the sensor 1410 may comprise a buoyant core 1420 that allows the sensor 1410 to float on the surface of the water. In some implementations, the sensor 1410 may be connected by a line 1405 that may be anchored to the aft portion of a surfboard 1430. In some embodiments, the mechanical control line 1440 may extend from the base of the sensor 1410.

Figure 15:
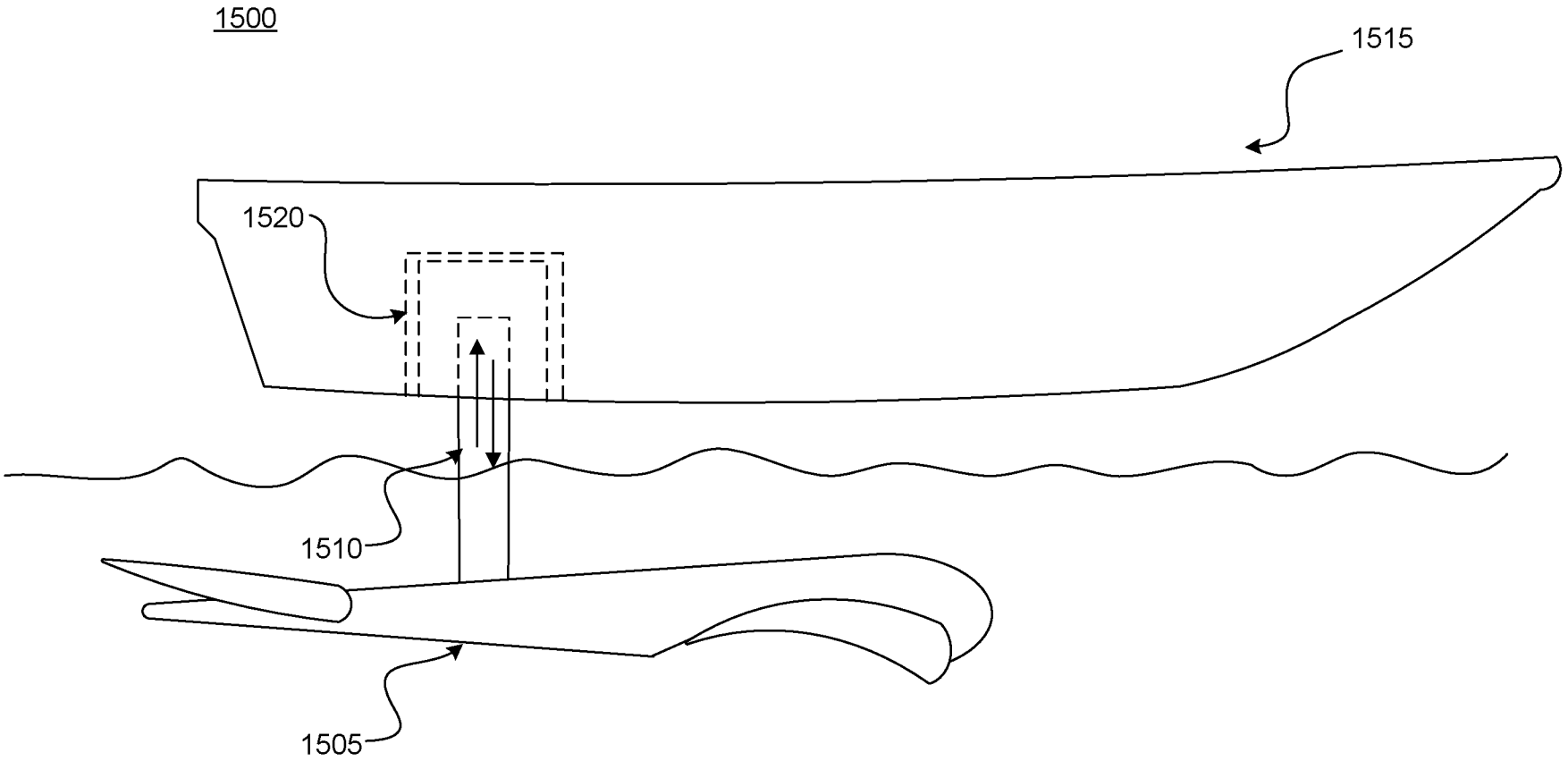
FIG. 15 illustrates an alternate exemplary hydrofoil system, according to some embodiments of the present disclosure.

Referring now to FIG. 15, a side view of an alternate exemplary hydrofoil system 1500 is illustrated. In some aspects, a hydrofoil device 1505 may be connected to a boat 1515. In some embodiments, the strut 1510 of the hydrofoil device 1505 may extend into the hull 1520 of the boat 1515. In some implementations, the strut 1510 may be manually or automatically manipulated, such as through connection to a motor. In some embodiments, the hydrofoil device 1505 may be actively controlled, such as through connection to a power source and communication device. In some aspects, the boat 1515 may further comprise a lead ballast that may be shifted to provide a counter balance, effectively substituting the ability of a rider of a surfboard to actively shift weight as a hydrofoil system glides through water.

Figure 16:
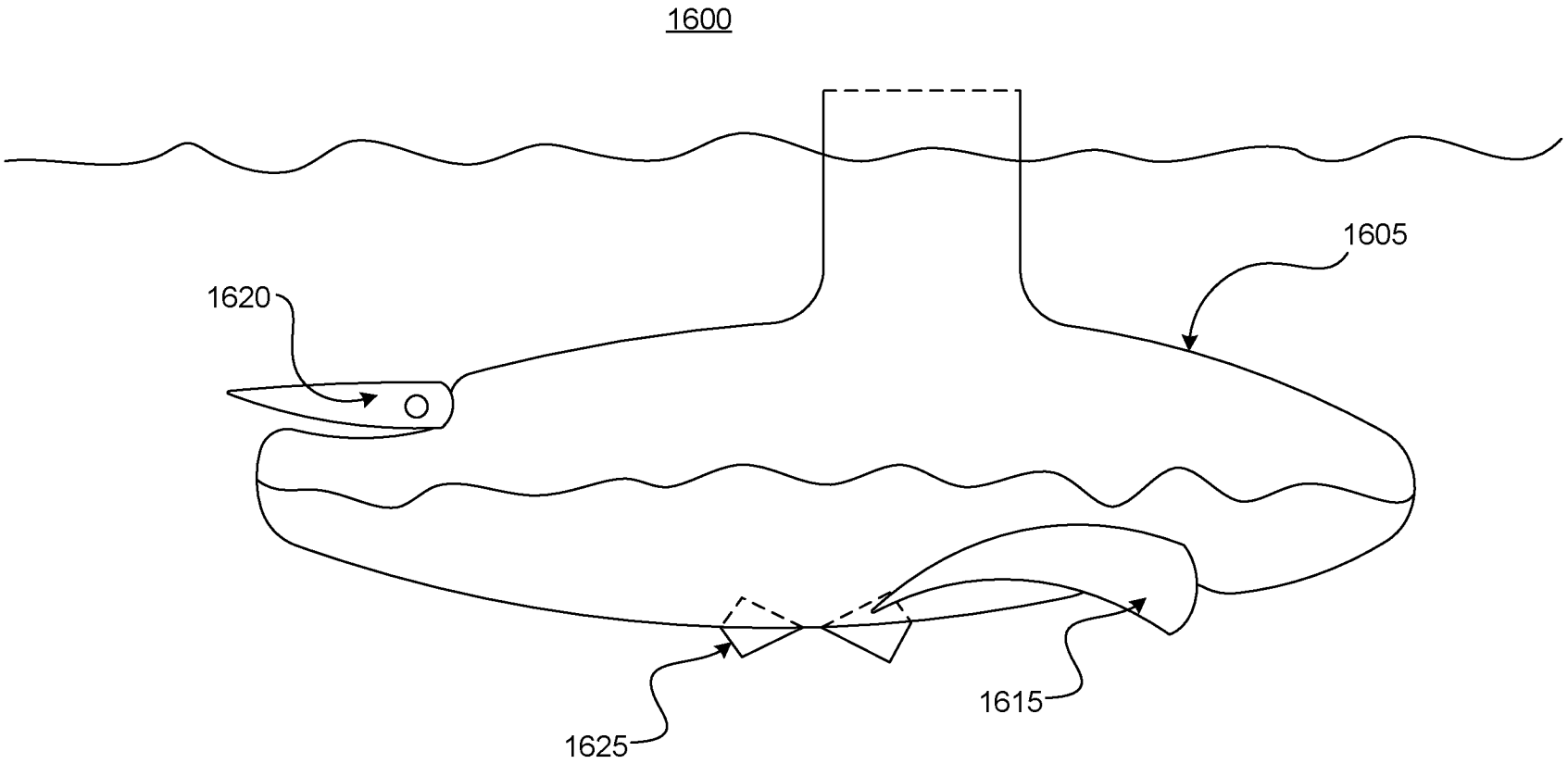
FIG. 16 illustrates an exemplary commercial hydrofoil device, according to some embodiments of the present disclosure.

Referring now to FIG. 16, a side view of a commercial hydrofoil device 1600 is illustrated. In some embodiments, a commercial hydrofoil device 1600 may comprise a wide fuselage 1605 with a valve 1625 that may control the intake and purging of water into the fuselage 1605, wherein the water level within the fuselage 1605 may adjust the buoyancy of the commercial hydrofoil device 1600. In some aspects, the commercial hydrofoil device 1600 may comprise a back wing 1620 and a front wing 1615 that may be independently manipulated.

Figures 17A, 17B:
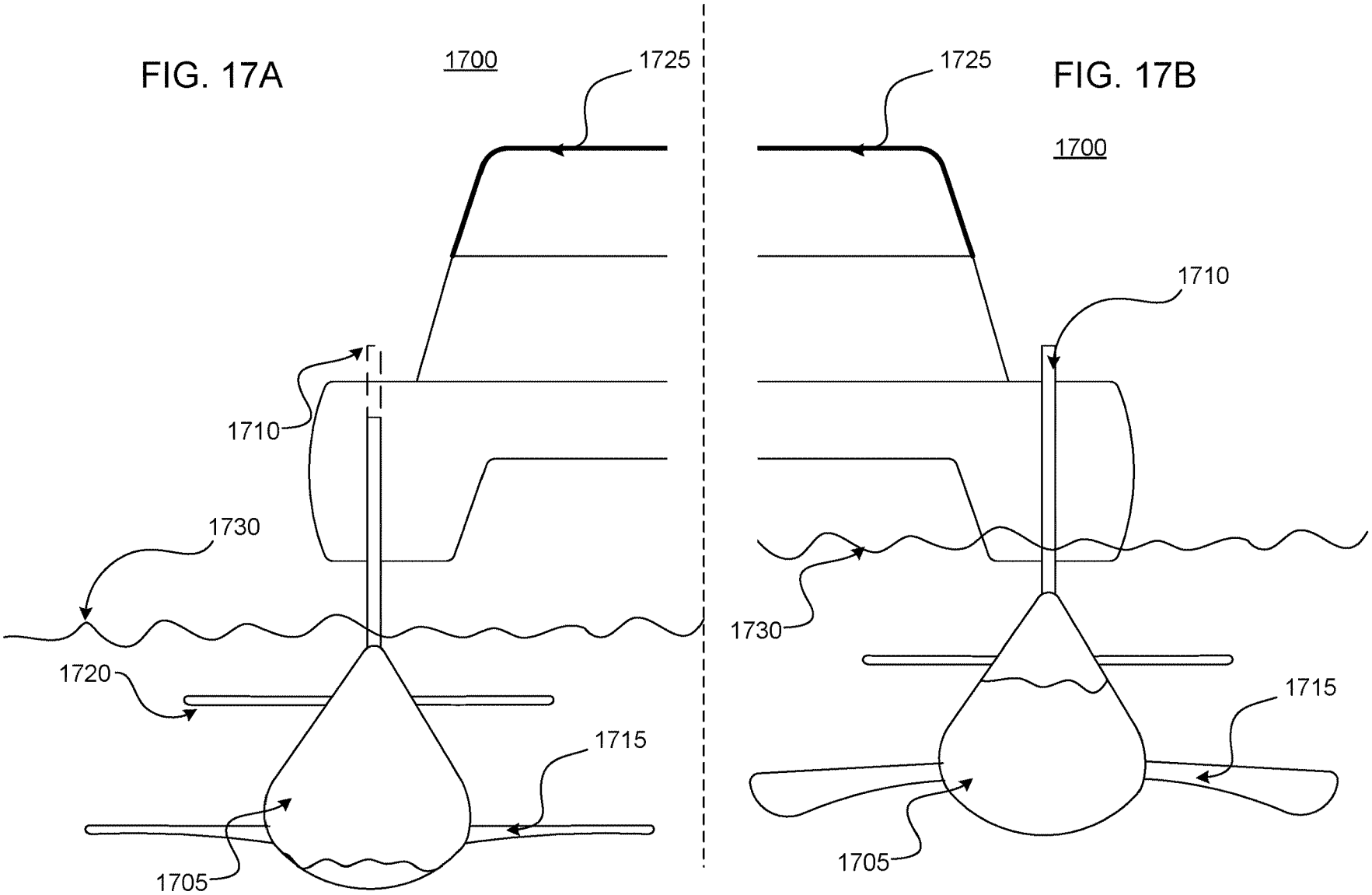
FIG. 17A illustrates an exemplary commercial hydrofoil system in a lifting state, according to some embodiments of the present disclosure.
FIG. 17B illustrates an exemplary commercial hydrofoil system in a resting state, according to some embodiments of the present disclosure.

Referring now to FIGS. 17A and 17B, front views of a commercial hydrofoil system 1700 are illustrated. In some aspects, a commercial vessel 1725 may be propelled by a series of commercial hydrofoil devices 1705-1720. In some embodiments, a commercial hydrofoil system 1700 may comprise a fuselage 1705 with adjustable buoyancy connected to the commercial vessel through a strut 1710 that may extend through the hull of the commercial vessel 1725.

In some aspects, such as illustrated in FIG. 17A, the fuselage 1705 may have increased buoyancy in gliding mode, wherein the commercial vessel 1725 glides over the water surface 1730 and the front wing 1715 and back wing 1720 may be in cruise position. In some embodiments, such as illustrated in FIG. 17B, the fuselage 1705 may have decreased buoyancy in resting and rising mode, wherein the commercial vessel 1725 may be in contact with the water surface 1730. In rising mode, the front wing 1715 may pivot to direct water flow and cause lift of the commercial hydrofoil system.

Figure 18:
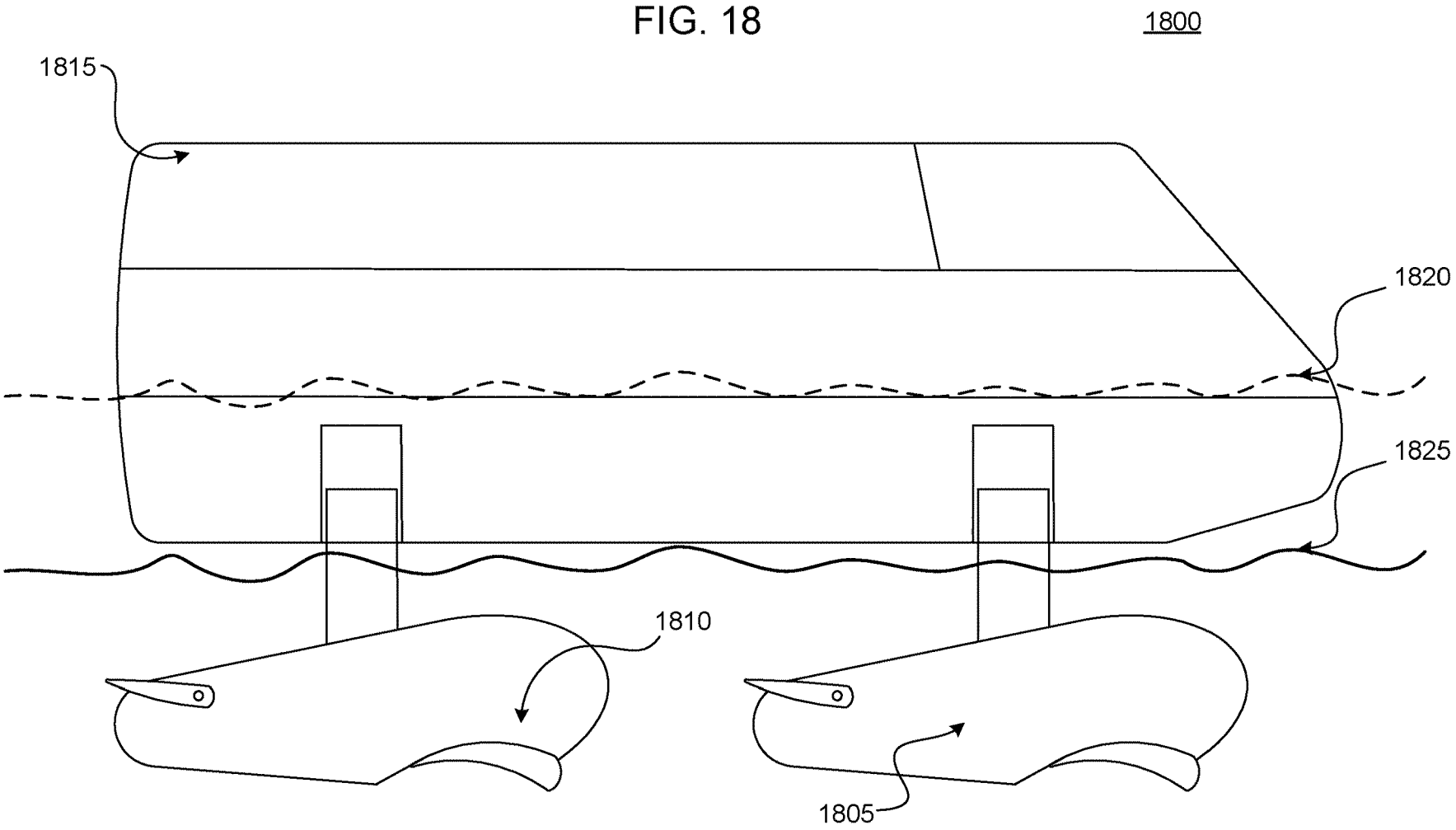
FIG. 18 illustrates a side view of an exemplary commercial hydrofoil system, according to some embodiments of the present disclosure.

Referring now to FIG. 18, a side view of an exemplary commercial hydrofoil system 1800 is illustrated. In some aspects, a commercial hydrofoil system 1800 may comprise a commercial vessel 1815 propelled by a plurality of hydrofoil devices 1805, 1810. In some embodiments, the commercial hydrofoil system 1800 may comprise four hydrofoil devices 1805, 1810 with two positioned on each side of the hull of the commercial vessel 1815. In some aspects (not shown), the commercial hydrofoil system 1800 may comprise two hydrofoil devices with one positioned on each side of the hull, wherein each hydrofoil device may be connected to the commercial vessel 1815 through at least two struts. In some implementations, the hydrofoil system 1800 may allow the commercial vessel 1815 to operate at different water levels, such as under a water surface 1820 and hovering above the water surface 1825.

CONCLUSION

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A hydrofoil device connected to a vessel comprising:
- a front wing comprising:
  - a convex upper surface,
  - a concave lower surface, and
- a hinge point;
- a back wing;
- a fuselage comprising:
  - an elongated body, wherein the front wing is connected by the hinge point to a forward portion of the elongated body, and wherein the back wing is connected to an aft portion of the elongated body, and wherein the front wing pivots within a range; and
- a strut connected to the elongated body and connectable to the vessel.

2. The hydrofoil device of claim 1, wherein the back wing further comprises a back hinge.

3. The hydrofoil device of claim 2, wherein the back wing is manually adjustable to control an angle of the back wing.

4. The hydrofoil device of claim 2, wherein the back hinge allows the back wing to fluctuate within a predefined range.

5. The hydrofoil device of claim 1, wherein the front wing comprises flexible hydrons.

6. The hydrofoil device of claim 1, wherein at least a portion of the hydrofoil device comprises a buoyant material.

7. The hydrofoil device of claim 1, wherein the fuselage is comprised of carbon fiber or other rigid composite materials.

8. The hydrofoil device of claim 1, wherein at least a portion of one or both the front wing and the back wing are comprised of a buoyant material.

9. The hydrofoil device of claim 8, wherein the back wing is comprised of a concave upper surface and a convex lower surface.

10. A hydrofoil device connected to a surfboard comprising:
- a front wing comprising:
  - a convex upper surface,
  - a concave lower surface,
  - a hinge point;
- a back wing;
- a fuselage comprising:
  - an elongated body, wherein the front wing is connected by the hinge point to a forward portion of the elongated body, and wherein the back wing is connected to an aft portion of the elongated body, and wherein the front wing pivots within a range; and
- a strut connected to the elongated body and connectable to the surfboard.

11. The hydrofoil device of claim 10, where the hinge point is located on the front wing.

12. The hydrofoil device of claim 10, wherein at least a portion of one or both the front wing and the back wing includes a semi-flexible material.

13. The hydrofoil device of claim 10, wherein the back wing further comprises a concave upper surface and convex lower surface.

14. The hydrofoil device of claim 10, wherein the front wing further comprises one or more flexible hydrons.

15. The hydrofoil device of claim 10, wherein the fuselage comprises an adjustable buoyancy.

16. The hydrofoil device of claim 10, wherein the strut comprises a base, wherein the base is connectable to the surfboard.

17. The hydrofoil device of claim 10, wherein at least a portion of one or more the front wing, the back wing, the fuselage, and the strut comprise a buoyant material.

18. The hydrofoil device of claim 17, wherein the buoyant material allows the hydrofoil device to float when in water.

19. The hydrofoil device of claim 10, wherein the surfboard comprises a plurality of channels on an undersurface of the surfboard.

20. The hydrofoil device of claim 19, wherein the plurality of channels forms a grooved surface.

* * * * *